United States Patent [19]

Tristram

[11] 3,987,908

[45] Oct. 26, 1976

[54] MINING APPARATUS

[75] Inventor: William Francis Tristram, Kirkby-in-Ashfield, England

[73] Assignee: Dowty Mining Equipment Limited, Tewkesbury, England

[22] Filed: Dec. 17, 1975

[21] Appl. No.: 641,606

[30] Foreign Application Priority Data

Dec. 17, 1974 United Kingdom ..... 54818/74

[52] U.S. Cl. ..... 214/1 MS; 214/1 BS; 299/18; 299/33

[51] Int. Cl.[2] ..... E21C 35/20

[58] Field of Search ..... 214/1 MS, 1 BB; 299/18, 299/33

[56] References Cited

UNITED STATES PATENTS 2,507,251 5/1950 Herold ..... 214/1 MS

FOREIGN PATENTS OR APPLICATIONS 1,381,737 11/1964 France ..... 214/1 MS

*Primary Examiner*—L. J. Paperner
*Assistant Examiner*—George F. Abraham
*Attorney, Agent, or Firm*—Young & Thompson

[57] ABSTRACT

This invention concerns a ripping platform for use in a mine to support the roof above an excavated stratum of mineral to facilitate excavation or ripping away of the roof to provide a roadway. In accordance with the invention a ripping platform to receive and distribute debris from a mine roof comprises a trough for location under the mine roof, a first deck within the trough reciprocable in a direction lengthwise of the trough at a level above the bottom of the trough, reciprocating mechanism for the deck located in the trough under the deck, an impeller member secured to one end of the first deck and extending downwardly from the deck to the bottom of the trough, and a second deck in the trough closely engaging the first deck, the first and second decks and the impeller defining a zone between the decks and the trough bottom that is substantially isolated from the debris, the said zone containing the reciprocating mechanism. Reciprocation of the first deck and impeller by the reciprocating mechanism will discharge debris from one end of the trough into a position at the side of the roadway.

14 Claims, 8 Drawing Figures

MINING APPARATUS

This invention relates to a ripping platform for use in mining and in particular in the longwall mining system. In the longwall mining system used for excavating mineral from a thin stratum, say less than 6ft in thickness, excavation takes place at a longwall working face in the stratum. For ease of access to the working face a roadway or tunnel is driven through the space from which mineral has been excavated, usually known as the goaf, and is continually extended as the working face advances. The roof of the goaf is cut away until the working dimensions of the roadway are obtained. Such dimensions could be 10ft high by 10ft wide. The debris excavated from the roof of the roadway is then deposited along the sides of the roadway in the goaf and roof arches are erected to support the roof and walls of the roadway. The cutting away of the roof to form the roadway is carried out immediately behind the working face and is usually referred to as "ripping". The ripping platform to which the present invention relates is a device which collects debris ripped from the roof during cutting of the roadway and which propels this debris into the goaf at the sides of the roadway.

In accordance with the present invention a ripping platform comprises a trough adapted for location under a mine roof adjacent to a mineral working face to receive debris from the roof, a first deck within the trough at a level above the bottom of the trough and reciprocable in a direction lengthwise of the trough, reciprocating mechanisms for the deck located in the trough under the deck, an impeller member secured to one end of the first deck and extending downwardly from the deck to the bottom of the trough, and a second deck in the trough closely engaging the first deck, the first and second decks and the impeller defining a zone between the decks and the trough bottom that is substantially isolated from the debris, said zone containing the reciprocating mechanism.

The second deck may itself be reciprocable lengthwise of the trough and may include a second impeller secured to one end thereof and extending downwardly to the trough bottom, said second impeller assisting in defining the said zone.

Alternatively the second deck may be fixed in position within the trough.

The reciprocating mechanism may include a first hydraulic jack for reciprocating the first deck and impeller, and may include a second hydraulic jack for reciprocating the second deck and impeller.

A scraper may be fixed across the trough to engage the upper surface of a reciprocable deck.

A table may be secured to one side of the trough for collecting debris from the mine roof and feeding such debris into the trough. The table may be pivotally connected to the side of the trough and raisable to assist in the movement of the debris from the table to the trough.

The platform may include adjustable hydraulic legs engageable with the mine floor to support the ripping platform in its operative position.

A side stake may be located across the trough at either end thereof and may be adjustable in height by variable length hydraulic jacks to engage the roof at either side of the ripping platform.

The edge of the trough remote from the table may be castellated in order to provide roof support and to enable auxiliary roof supporting bars to pass between the castellations to engage the roof above the trough.

An auxiliary ram device may be reciprocable lengthwise under the trough and extendible beyond one end of the trough.

One embodiment of the invention will now be described with reference to the accompanying drawings, in which.

Figure 6:
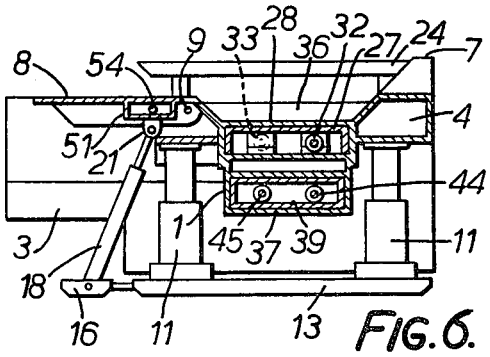
FIG. 6 is a cross-section on the line VI—VI of FIG. 2.
Figure 7:
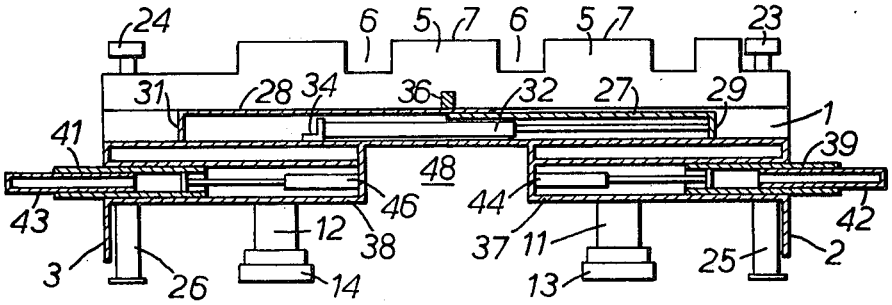
FIG. 7 is a cross-section on the line VII—VII of FIG. 5.

The structural framework of the ripping platform is comprised by an elongate trough 1, to which are secured a pair of end plates 2 and 3. The front edge 4 of the trough is of box structure and carries a plurality of castellations 5 having spaces 6 therebetween. The upper surfaces 7 of these castellations are intended for roof engagement. The rear edge of the trough has a table 8 pivotally secured thereto by hinge pins 9 (see FIG. 6) parallel to the length of the trough.

The structural framework is supported by four extendible hydraulic jacks arranged in two pairs 11 and 12 of which the pair 11 rests on a floor beam 13 and the pair 12 rests on a floor beam 14. Both floor beams extend transversely of the length of the trough. The pair of pads 15 and 16 secured to the rear ends of the beams 13 and 14 carry hydraulic jacks respectively 18 and 19 which extend to pivotal connections 21 and 22 on the underside of the table 8. The function of the jacks 18 and 19 is to adjust the table position inbetween the fully lowered position of FIG. 6 into the fully raised position of FIG. 2.

For the purpose of anchoring the framework in its operative position a pair of roof engaging side stakes 23 and 24 are provided, located one across each end of the trough. The stake 23 is urged into engagement with the roof by a pair of hydraulic jacks 25, whilst stake 24 is urged into engagement with the roof by a pair of hydraulic jacks 26. The jacks 25 and 26 are slidably mounted within box structures attached to the side plates 2 and 3 and the whole framework may move vertically relatively to the jacks 25 and 26 by extension or contraction of the main supporting jacks 11 and 12.

Within the trough a pair of reciprocating decks 27 and 28 are provided. The deck 27 slides underneath deck 28 but substantially in contact therewith. An impeller member 29 extends downwardly from one end of deck 27 to engage the bottom of the trough 1. Similarly an impeller 31 extends downwardly from one end of the deck 28 to engage the bottom of the trough. In between the decks and the bottom of the trough a zone is defined within which a pair of reciprocating jacks 32 and 33 are located. The jack 32 is connected between an anchorage 34 at the bottom of the trough and the impeller 29, whilst the jack 33 is connected to an anchorage 35 secured to the bottom of the trough and to the impeller 31. Thus reciprocation of the jack 32 will reciprocate the deck 27 and reciprocation of the jack 33 will reciprocate the deck 28. A fixed scraper bar 36 is secured centrally between the sides of the trough and rests substantially in engagement with the deck 28. The bar 36 may be adjustable into different fixed positions across the trough to bias displacement of debris in one direction or the other from the trough.

A pair of boxes 37 and 38 are secured to the underside of the trough, one at either end. Within box 37 a hollow rectangular section slider 39 is reciprocable, a part thereof capable of projecting through the side plate 3. Similarly a hollow slider of rectangular section 41 is located within the box 38 for reciprocation through the hole in the end plate 2. The sliders, 39 and 41, both include a cavity of rectangular section within which respectively inner sliders 42 and 43 are slidable. Within the box 37 a pair of jacks 44 and 45 are located, the jack 44 being connected between the box and the slider 39 whilst the jack 45 is connected between the two sliders 39 and 42. Similarly the box 38 contains a pair of jacks 46 and 47 for reciprocation of the sliders 41 and 43.

It will be seen that a gap 48 is provided under the trough between the two boxes 37 and 38. The purpose of this gap is to provide access for miners and equipment from the roadway to the working coal face.

The table 8 at either end thereof adjacent to its hinge axis is provided with a box respectively 49 and 51 within which respectively sliders 52 and 53 are located. Each box 49 and 51 includes a hydraulic jack 54 (see FIG. 6) to urge its slider outwardly. The sliders 52 and 53 at their extreme ends carry spring loaded fingers 54 and 55.

For use the ripping platform is located at the end of the roadway adjacent to the working face, the trough being located underneath the edge of the roof which is to be excavated to form the roadway, whilst the table 8 is just in front of the edge of the roof. This edge of the roof is referred to as the ripping lip. The side stakes 23 and 24 are then set against the roof and the jacks 11 and 12 are operated to raise the whole platform structure so that the upper surfaces 7 of the castellations 5 make contact with the roof adjacent to the working face. In between the ripping platform as illustrated and the actual working face, mine roof supports of a special form, known as ripping lip supports, are employed which include cantilever roof bars intended to project through the spaces 6 between the castellations 5 to support the roof over the trough 1. The portion of the roof above the ripping lip is then cut away in a conventional manner, as by using a ripping machine or by use of explosives. The debris cut away from the roof will fall onto the table 8 and into the trough 1. At this point it is necessary for the operator to decide how much of the debris will be dumped on either side of the roadway into the goaf. In some instances it is possible that a major part of the debris will need to be dumped on one side of the road rather than on the other.

Figure 1:
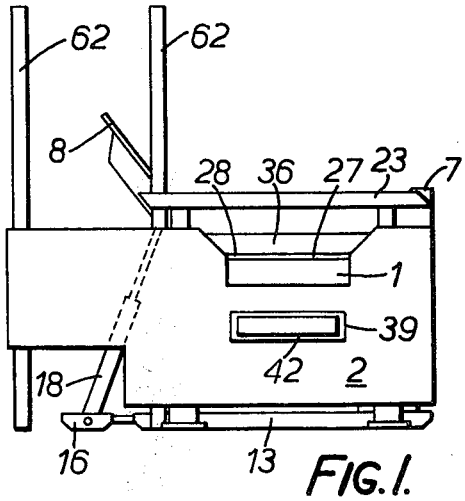
FIGS. 1, 2 and 3 are respectively side, rear and front elevations of the ripping platform.
Figure 2:
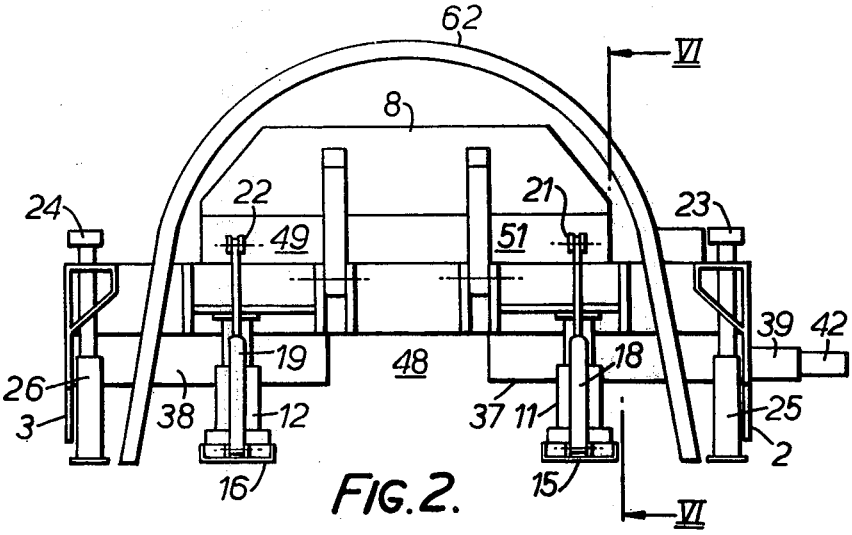
Figure 3:
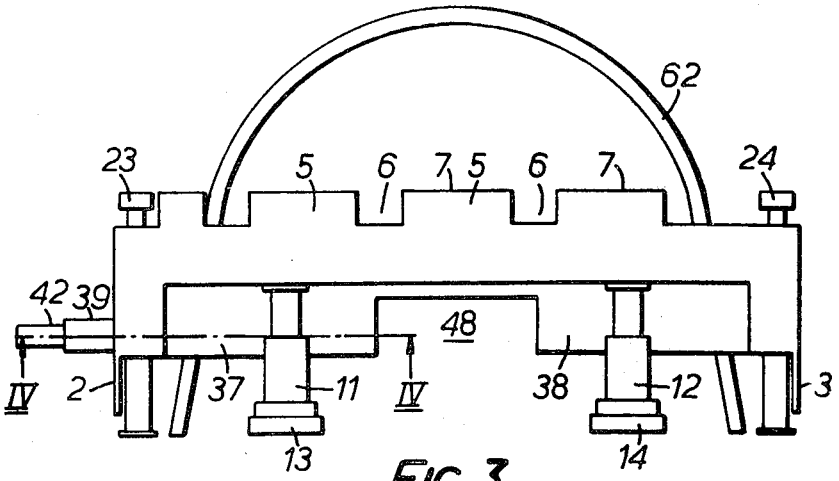
Figure 4:
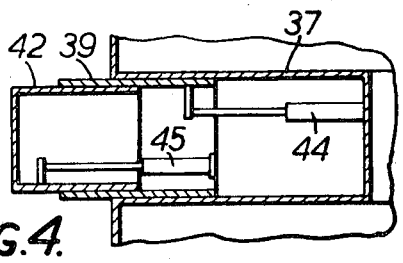
FIG. 4 is a partial cross-section on the line IV—IV in FIG. 3.
Figure 5:
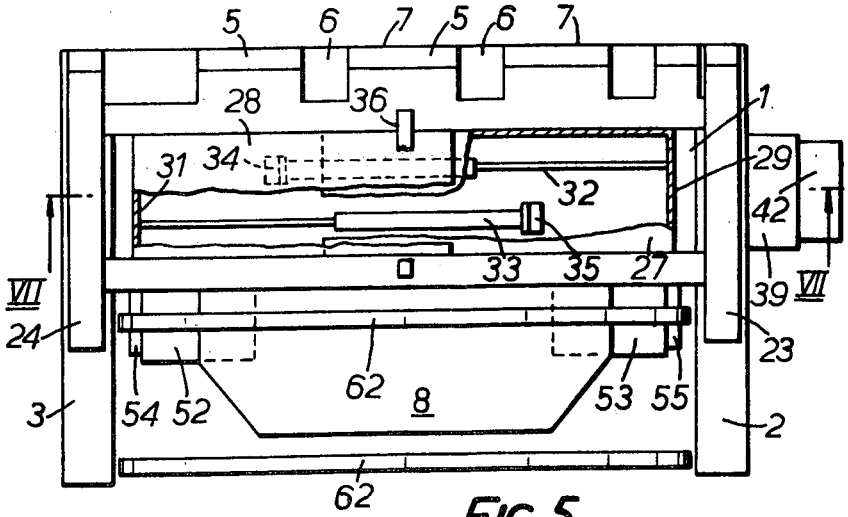
FIG. 5 is a plan view of the ripping table partially in section to show the jacks under the reciprocating decks.
Figure 8:
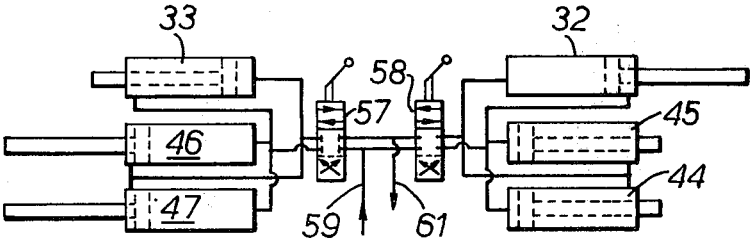
FIG. 8 is a hydraulic circuit diagram showing the connections for the hydraulic reciprocating jacks.

For the purpose of dumping, a hydraulic control circuit for the jacks 32, 33, 44, 45, 46 and 47 is provided as shown in FIG. 8. The jacks are all double acting and are controlled by a pair of simple manually operable reversing valves 57 and 58. For the left-hand side of the platform as seen in FIGS. 2 and 5, the reversing valve 57 is connected between, on the one hand, a pressure supply connection 59 and a drain connection 61 and, on the other hand, the three jacks effectively connected in parallel, the connections being such that the jacks 46 and 47 will move in the same sense but the jack 33 will move in the opposite sense.

Similarly the reversing valve 58 is connected between, on the one hand, the pressure connection 59 and the drain connection 61 and, on the other hand, the three jacks 32, 45 and 46. The jacks 45 and 46 are connected for movement in the opposite sense to the jack 32.

Assume now that the operator has decided to dump debris to the left-hand side of the platform, he will operate the valve 57 firstly in one direction and then in the other. The deck 28 in the trough 1 will then reciprocate, inward movement pushing the deck 28 under the debris and allowing debris to fall into the trough in front of the impeller 31, and outward movement of the deck 28 causing such debris to be engaged by the impeller 31 and discharged from the left-hand end of the trough 1 into the goaf. During retraction of the deck 28 the telescopic sliders 41 and 43 will extend and will engage the upper parts of the pile of debris dumped from the trough 1 into the goaf and will push such debris further into the goaf, packing it into position. The operator will continue reciprocating the deck 28 and the sliders 41 and 43 until he has sufficient debris packed into the left-hand side of the roadway. By reciprocation of the valve 58 the operator may also reciprocate the deck 27 and the sliders 39 and 42, the sliders moving oppositely to the deck 27 and impeller 29 and pushing further into the goaf the debris discharged by the impeller 29 from the right-hand end of the trough 1. The fixed scraper bar 36 operates during discharge of debris to ensure that movement of either deck towards the fixed scraper will not cause movement of the debris towards the scraper. On the other hand, however, movement of each deck 27 or 28 away from the scraper will carry debris with it towards the associated impeller. The scraper may be fixed in a different position in order to bias delivery of debris to one end of the trough. After debris has been discharged from the trough there will still remain some debris on the table 8 and to ensure discharge of this debris into the goaf, the table 8 is raised by means of the hydraulic jacks 18 and 19. The debris that it carries will then fall into the trough 1 and reciprocation of the decks 27 and 28 by the valves 57 and 58 will then discharge the debris into the goaf from either side of the roadway. Whilst the table 8 is in its lowermost position the sliders 52 are maintained extended so that the table collects as much debris as possible for discharge into the trough 1. The excavated roof at the end of the roadway, is supported by an arch support or supports 62 placed in position immediately following the ripping operation, and during raising of the table 8 it is necessary to ensure that the sliders 52 and 53 do not foul the adjacent arch 62. The miner controlling the operation must therefore ensure that the sliders 52 and 53 are not extended too far. At the same time the spring fingers, 54 and 55 at the outer ends of the sliders 52 and 53 can engage the arch supports 62 and will displace inwardly against spring force if they make contact with the arch 62. Clearly the dimensions of the table 8 are limited by the height of the arch 62, as will be appreciated from FIG. 2, and it will be seen that during raising of the table 8 the sliders 52 and 53 will prevent some of the debris from falling directly on the road floor. After completion of a ripping operation and discharge of the debris into the goaf the whole platform is advanced forwardly for another ripping operation. For this purpose advancing jacks may be secured between the floor beams 13 and 14 and the ripping lip supports referred to above.

Various modifications of the invention are possible within the broad scope of the present invention as follows:

a. Where the ripping platform is intended to deliver debris to one side only of the roadway one deck only may be fixed positively in position over about one-half of the length of the trough bottom opposite to the trough end from which delivery is required. Preferably the fixed deck will be the upper deck. Only one reciprocating jack is then necessary to reciprocate the reciprocating deck.

b. The fixed scraper may be dispensed with either in the illustrated construction or in the construction set out in (a) above with the disadvantage that the trough can never be completely clear of debris and that the reciprocating deck or decks and impeller, or impellers, will operate effectively only when there is a considerable pile of debris over the trough.

c. The sliders under the trough may be disposed with where there is no need to push the debris deeply into the goaf.

d. The table may be fixed rather than pivoted and may be provided with an upstanding peripheral flange to improve its ability to collect debris. Means may be provided on the fixed table to propel debris towards the trough.

e. In cases where the ripping platform is intended to work in an excavated seam of constant height, i.e. where the coal cutting machine is a simple drum cutter making a single pass, the adjustable supporting legs 11 and 12 may be replaced by legs of fixed height.

I claim:

1. A ripping platform comprising a trough adapted for location under a mine roof adjacent to a mineral working face to receive debris from the roof, a first deck within the trough reciprocable in a direction lengthwise of the trough at a level above the bottom of the trough, reciprocating mechanism for the deck located within the trough under the deck, an impeller member secured to one end of the first deck and extending downwardly from the deck to the bottom of the trough, and a second deck in the trough closely engaging the first deck, the first and second decks and the impeller defining a zone between the decks and the trough bottom that is substantially isolated from the debris, said zone containing the reciprocating mechanism.

2. A ripping platform as claimed in claim 1, including a second reciprocating mechanism located in the zone and connected for reciprocation of the second deck and a second impeller secured to one end of the second deck and extending downwardly to the trough bottom, said second impeller assisting in defining the said zone.

3. A ripping platform as claimed in claim 1, wherein the second deck is fixed in position within the trough.

4. A ripping platform as claimed in claim 1, wherein the reciprocating mechanism comprises a first hydraulic jack for reciprocating the first deck and impeller.

5. A ripping platform as claimed in claim 2, wherein the second reciprocating mechanism comprises a second hydraulic jack for reciprocating the second deck and impeller.

6. A ripping platform as claimed in claim 1, including a scraper fixed in position across the trough to engage the upper surface of a reciprocable deck.

7. A ripping platform as claimed in claim 1, including a table secured to one side of the trough for collecting debris from the mine roof and feeding such debris into the trough.

8. A ripping platform as claimed in claim 7, including a pivotal connection securing the table to the side of the trough and means for moving the table about the said pivotal connection to assist in the movement of debris from the table to the trough.

9. A ripping platform as claimed in claim 1, including at least one adjustable hydraulic leg engageable with the mine floor to support the platform in its operative position.

10. A ripping platform as claimed in claim 1, including a roof supporting side stake secured across the trough at either end thereof.

11. A ripping platform as claimed in claim 10, including variable length hydraulic rams to support each side stake in position against the roof, said rams reacting against the floor and slidable engaging means by which the platform engages over the said rams such that when the side stakes engage the roof the rams will locate the platform against transverse movement.

12. A ripping platform as claimed in claim 7, wherein the side of the trough remote from the table includes castellations to engage the roof above the trough.

13. A ripping platform as claimed in claim 1, including a pusher device reciprocable lengthwise under the trough beyond one end of the trough.

14. A ripping platform as claimed in claim 13, wherein the pusher device comprises a pair of telescoping box structures reciprocable by means of hydraulic jacks located within them.

* * * * *